United States Patent [19]

Hoeboer et al.

[11] Patent Number: 4,748,836

[45] Date of Patent: Jun. 7, 1988

[54] METHOD OF FORMING A RIDGE IN A TUBE MEMBER

[75] Inventors: Willebrordus C. Hoeboer, Amsterdam; Antoni J. Mulhof, Wierden; Gerrit J. Rake, Hengelo, all of Netherlands

[73] Assignee: Ultra-Centrifuge Nederland N.V., Almelo, Netherlands

[21] Appl. No.: 23,509

[22] Filed: Mar. 9, 1987

[30] Foreign Application Priority Data

Mar. 10, 1986 [NL] Netherlands ..... 8600617

[51] Int. Cl.[4] ..... B21D 15/10

[52] U.S. Cl. ..... 72/58; 72/61; 72/62; 29/421 R

[58] Field of Search ..... 72/54, 56, 58, 60, 61, 72/62, 901; 29/421 R

[56] References Cited

U.S. PATENT DOCUMENTS

| | | | |
|---|---|---|---|
| 2,631,640 | 3/1953 | Zallea | 72/58 |
| 4,179,910 | 12/1979 | Mazier | 72/62 |
| 4,414,834 | 11/1983 | Gratzer et al. | 72/62 |

FOREIGN PATENT DOCUMENTS

| | | | |
|---|---|---|---|
| 604636 | 10/1934 | Fed. Rep. of Germany . | |
| 11204409 | 12/1961 | Fed. Rep. of Germany | 72/62 |
| 2096474 | 2/1972 | France . | |
| 84231 | 6/1980 | Japan | 72/61 |

OTHER PUBLICATIONS

Patent Abstracts of Japan, vol. 4, No. 80 (M-15) (562), 3/21/1980.

Patent Abstracts of Japan, vol. 8, No. 28 (M-274) (1465), Feb. 7, 1984.

*Primary Examiner*—David Jones

*Attorney, Agent, or Firm*—Cushman, Darby & Cushman

[57] ABSTRACT

A method of forming a ridge in a cylindrical tube member comprises placing the ends of the tube member into spaced-apart dies so that each die is a close fit around the respective end of the tube member, and the tube member has a free portion between the ends. Liquid is supplied to the interior of the tube member and the liquid pressure within the tube is increased so that its free portion bulges radially outwardly. While the radial bulge of the free portion of the tube member is continuously measured on the outside, the liquid pressure is gradually increased depending on the radial bulge measured until a pre-determined radial bulge is measured. Thereafter, while the liquid pressure is maintained in the tube member, the dies are axially moved towards each other until they are spaced a pre-determined axial distance apart. During this displacement the dies deform the bulge until the desired ridge form is reached. Thereafter, the liquid pressure within the tube member is released, the dies are axially moved apart, and the tube member is removed.

3 Claims, 3 Drawing Sheets

2
1
20

20
1
1
2
V
2

2
1
4

2
2
4
4
1
1

1
2
3

2
2
3
3
1
1

METHOD OF FORMING A RIDGE IN A TUBE MEMBER

This invention relates to a method of forming a ridge in a cylindrical tube member, for example for producing a bellows.

The invention relates in particular to a method of forming a ridge in a cylindrical tube member, which comprises placing the end portions of the tube member respectively in a first die and a second die so that each die is a close fit around the respective end portion of the tube member, the dies being set a pre-determined axial distance apart so that the tube member has a free portion between said end portions, supplying a liquid to the interior of the tube member and raising the liquid pressure within the tube member, thereby to cause the free portion of the tube member to bulge radially outwardly.

In a method of this kind which is already being applied, the liquid pressure within the tube member is gradually increased until a pre-determined end value is reached, and the pre-set axial distance of the dies relative to each other is maintained during this process. The ultimate form of the ridge being produced is thereby determined by the end value of the liquid pressure within the tube member and by the pre-set axial distance between the dies. Owing to unforeseen local differences in the wall thickness of the tube member and owing to unforeseen local differences in the material properties of the tube member, when series- or mass-produced, differences will occur in the shape of the ridges produced, for example, as regards their radial dimensions.Consequently, when this prior method is used, a good reproducibility of the product is not ensured.

It is an object of the present invention to improve the above method so as to remove these disadvantages.

To this effect, the method according to the invention is characterized by continuously externally measuring the radial bulge of the free portion of the tube member, gradually increasing the liquid pressure within the tube member depending on the measured radial bulge of the free portion of the tube member, continuing thus increasing the liquid pressure within the tube member until a pre-determined radial bulge of the free portion of the tube member is measured, axially moving the dies towards each other, while maintaining the liquid pressure obtained within the tube member, until the dies have reached a second radial distance from each other, during which displacement the dies deform the bulge until the desired ridge form is reached, releasing the liquid pressure within the tube member, moving the dies axially apart, and removing the tube member.

It is observed that U.S. Pat. No. 4,364,251 discloses a method for cold-working annular workpieces, in which the annular workpiece is clamped between two presser plates and, by means of fluid pressure within the workpiece the diameter is increased as uniformly as possible. As the diameter of the workpiece is increased, its height decreases somewhat, and the presser plates, to ensure a good seal, should be moved towards each other to some extent. By keeping the presser plates pressed against the workpiece being clamped between them, a good seal must be ensured, but on the other hand the compressive force must not be so high as to result in undesirable deformations. To realize all this, a relatively complicated measuring and control system is provided.

In one possible embodiment of the method according to the present invention, the tube member is pretreated so that its end portion has a thicker wall than its said free portion.

In this connection it is noted that the use of a tapering configuration in a tube to be processed is known per se, for example, from French patent application No. 2 096 474.

In the method according to the present invention, the radial bulge of the free portion of the tube member is preferably measured halfway said axial distance between the dies.

The invention will now be described in more detail with reference to the accompanying drawings, in which.

Figure 5:
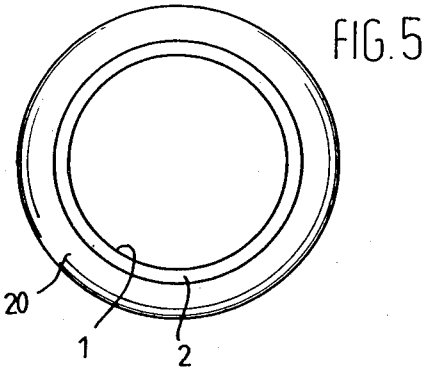
FIG. 5 shows a top plan view of the same tube member, but deformed by the method according to the present invention until the desired final configuration has been obtained.
Figure 6:
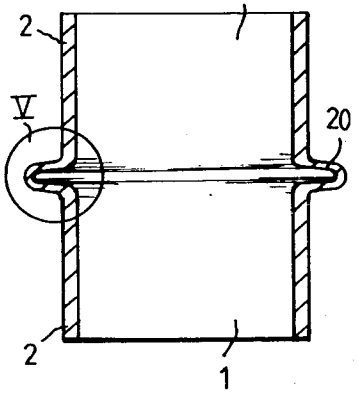
Figure 8:
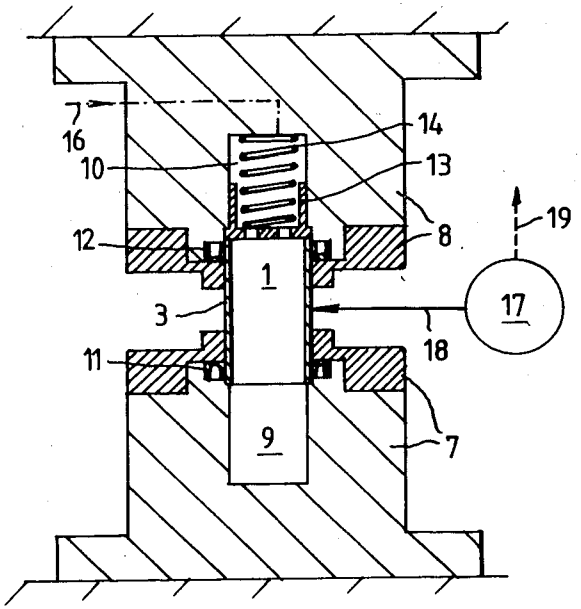
Figure 7:
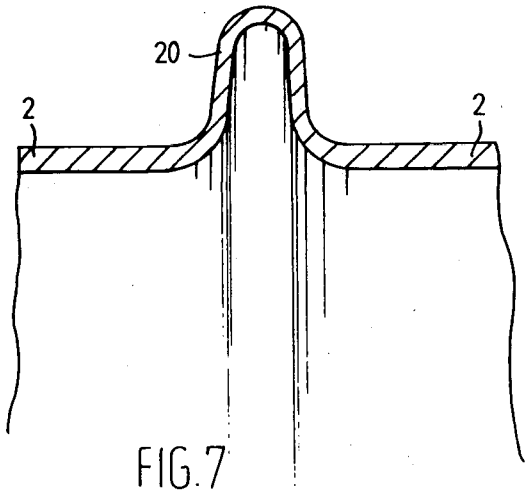
Figure 10:
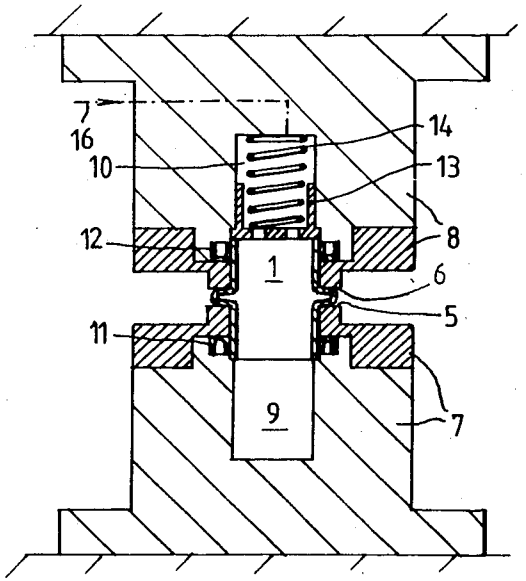
Figure 9:
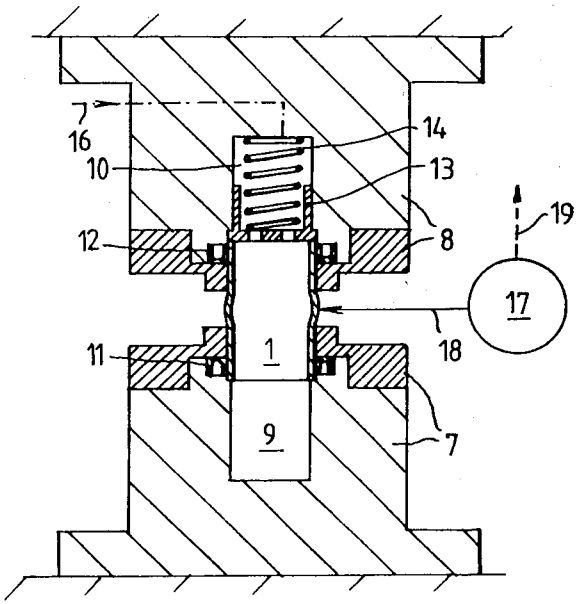

FIG. 6 somewhat diagrammatically shows a longitudinal sectional view of the final configuration of the tube member of FIG. 5;

FIG. 7 shows on a larger scale the portion V of FIG. 6 to clearly illustrate the ultimate configuration of the ridge;

FIG. 8 shows a first stage of the method according to the present invention, showing the appliance used in longitudinal sectional view;

FIG. 9 shows a second stage of the method according to the present invention, showing the appliance used in longitudinal sectional view; and FIG. 10 shows a third and last stage of the method according to the present invention, showing the appliance used in longitudinal sectional view.

Figure 1:
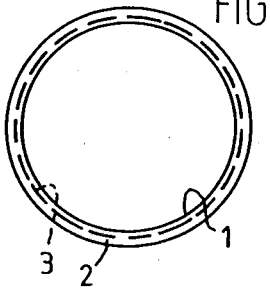
FIG. 1 shows a plan view of a cylindrical tube member in which a ridge must be formed.
Figure 2:
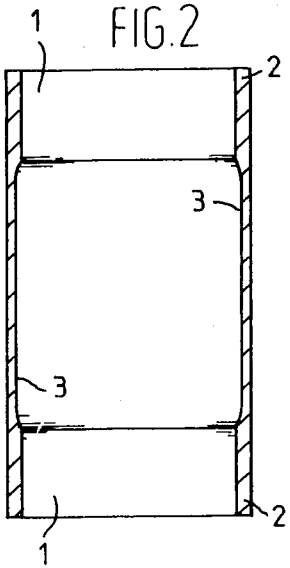
FIG. 2 shows a longitudinal sectional view of the tube member shown in FIG. 1.

The tube member in which the ridge is to be formed is designated in the accompanying drawings by reference numeral 1. The two end portions of tube member 1 are designated by reference numeral 2 and the central or free portion of tube member 1 is designated by reference numeral 3. The tube member is obtained, for example, by severing a desired length from an annealed drawn CuBe tube. The central portion 3 may, if desired, be internally worked by suitable machining to make the wall thickness of the central portion 3 less than the wall thickness of the two end portions 2, as shown in the embodiment of FIG. 2. In that case the tube member 1 of FIGS. 1, 2 is the starting product obtained. However, this reduction in wall thickness of the tube member is not required.

Apparatus for carrying out the method according to the invention, as illustrated in FIGS. 8–10, comprises a first die 7 and a second die 8. These dies are mounted in a suitable machine tool so that they can be moved axially towards and away from each other. In addition, the dies can be centered relatively to each other, for example, by means of a centering pin. Die 7 is provided with an axial central cylindrical aperture 9 and die 8 is provided with an axial central cylindrical aperture 10. Aperture 9 is provided with fluid-tight sealing means 11 and aperture 10 is provided with fluid-tight sealing means 12. Provided in aperture 10 is a plunger 13 arranged to be axially slidable in aperture 10. Provided between plunger 13 and the bottom of aperture 10 is a compression spring 14. This compression spring 14 is an optional feature. Plunger 13 may alternatively be driven otherwise. Plunger 13 is provided with openings 15. The dash-dot line 16 diagrammatically indicates a duct, through which liquid can be supplied under pressure to the interior of tube member 1. Reference numeral 17 designates a measuring apparatus provided with a feeler 18 for measuring the radial bulge of tube member 1. Dash-line 19 indicates a line for carrying a signal, for example, an electrical signal, produced by measuring apparatus 17.

The method according to the invention proceeds as follows.

The starting product, for example, tube member 1 as illustrated in FIGS. 1 and 2, or a similar tube member without a reduced central portion is placed in one of the dies, for example, in die 7, after dies 7 and 8 have been axially moved apart to a sufficient extent. To this effect, tube member 1 is shifted with one end portion 2 into the axial central cylindrical aperture 9 to such a depth that the respective end portion 2 is closely fittingly surrounded by the wall of aperture 9. In that condition, sealing means 11 contact the respective end portion 2 of tube member 1. Thereafter die 8 is moved axially towards die 7, whereby the other end portion 2 of tube member 1 slides into the axial central cylindrical aperture 10 of die 8 to such a depth that the respective end portion 2 is closely fittingly surrounded by the wall of aperture 10. By virtue of spring 14, plunger 13 is in contact with the end of tube member 1. The sealing means 12 are then in contact with the respective end portion 2 of tube member 1.

In this condition, illustrated in FIG. 8, the central portion 3 of tube member 1 is entirely free and not surrounded by dies 7 and 8. Feeler 18 now touches the outer surface of the wall of the free portion 3, preferably in the centre of the free portion 3. In this condition, dies 7 and 8 are axially spaced a pre-determined distance apart. For this purpose there may be provided suitable stop means (not shown in the drawings).

Figure 3:
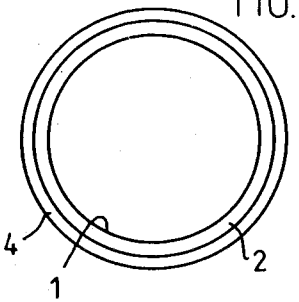
FIG. 3 shows a top plan view of a similar tube member, but partially deformed by the method according to the present invention.
Figure 4:
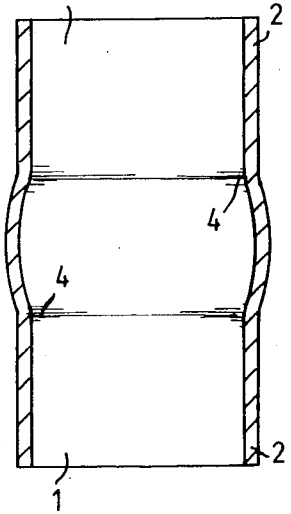
FIG. 4 shows a longitudinal sectional view of the partially deformed tube member illustrated in FIG. 3.

Liquid, for example, a suitable oil, is now supplied through duct 16, aperture 10 and openings 15 to the interior of tube member 1. The pressure of the liquid is gradually increased, for example, at a rate of 2 bar/sec. The increasing pressure in the interior of tube member 1 causes the free portion 3 to bulge gradually, that is to say, outwardly in the radial direction. Feeler 18, which is continuously in contact with the outer surface of the free portion 3 monitors the radial bulge and the measuring apparatus 17 produces a signal corresponding to the measured radial bulge, which signal is carried off through line 19. Depending on this produced signal, the increase in liquid pressure within tube member 1 is continued, and that until measuring apparatus 17 establishes a pre-determined radial bulge of the free portion 3. The corresponding signal from measuring apparatus 17 is an indication to terminate increasing the liquid pressure within tube member 1. After termination of the fluid pressure increasing procedure, tube member 1 is deformed, that is to say, it is provided with a central portion 3 with a bulge 4; as best shown in FIGS. 3 and 4. The condition reached is illustrated in FIG. 9.

While the liquid pressure within tube member 1 is maintained, dies 7 and 8 are then axially moved towards each other, until these dies have reached a pre-determined axial distance relative to each other. For this purpose there may be provided suitable stop means (not shown in the drawings). Surfaces 5 and 6 of the respective dies 7 and 8 are then in contact with bulge 4 and force the same to such a deformation as to ultimately produce a ridge having the desired shape. This condition is illustrated in FIG. 10, while the ridge formed, designated by reference numeral 20, is shown in greater detail in FIG. 7.

After releasing the liquid pressure within tube member 1, dies 7 and 8 are moved axially apart to the extent that tube member 1 can be removed from the apparatus.

If desired, tube member 1 with ridge 20 formed therein may be thereafter subjected to any further treatments that may be desired, for example, heat-treated.

We claim:

1. A method of forming a ridge in a cylindrical tube member, which comprises placing the end portions of the tube member respectively in a first die and a second die so that each die is a close fit around the respective end portion of the tube member, the dies being set a pre-determined axial distance apart so that the tube member has a free portion between said end portions, supplying a liquid to the interior of the tube member and raising the liquid pressure within the tube member, thereby to cause the free portion of the tube member to bulge radially outwardly, characterized by continuously externally measuring the radial bulge of the free portion of the tube member, gradually increasing the liquid pressure within the tube member depending on the measured radial bulge of the free portion of the tube member, continuing to increase the liquid pressure within the tube member until a pre-determined radial bulge of the free portion of the tube member is measured, terminating the increasing pressure in response to obtaining said pre-determined bulge and maintaining the pressure at the level which produced said pre-determined bulge, and then axially moving the dies toward each other until the dies have reached a second radial distance from each other, during which displacement the dies deform the bulge until the desired ridge form is reached, releasing the liquid pressure within the tube member, moving the dies axially apart, and removing the tube member from the dies.

2. A method as claimed in claim 1, characterized in that the tube member is pretreated so that its end portions have a thicker wall than its said free portion.

3. A method as claimed 1, characterized in that the radial bulge of the free portion of the tube member is measured halfway said axial distance between the dies.

* * * * *